United States Patent [19]

Tohyama et al.

[11] 4,358,836

[45] Nov. 9, 1982

[54] ELECTRONIC WATCH WITH AN AUTOMATIC TIME INDICATION MODIFIER

[75] Inventors: Nobuo Tohyama; Junichi Yoshida; Shozo Yamano; Kenji Kamiya, all of Ena, Japan

[73] Assignee: Ricoh Watch Co., Ltd., Nagoya, Japan

[21] Appl. No.: 94,631

[22] Filed: Nov. 15, 1979

[30] Foreign Application Priority Data

| | | | |
|---|---|---|---|
| Nov. 20, 1978 | [JP] | Japan | 53/142300 |
| Nov. 20, 1978 | [JP] | Japan | 53/142302 |
| Dec. 28, 1978 | [JP] | Japan | 53/161068 |
| Dec. 28, 1978 | [JP] | Japan | 53/161070 |
| Oct. 20, 1979 | [JP] | Japan | 54/135514 |

[51] Int. Cl.[3] ..... G04C 11/02

[52] U.S. Cl. ..... 368/47; 368/51

[58] Field of Search ..... 368/46, 49, 56–58, 368/51; 73/6

[56] References Cited

U.S. PATENT DOCUMENTS

| | | | |
|---|---|---|---|
| 3,881,310 | 5/1975 | Gerum et al. | 368/47 |
| 4,078,419 | 3/1978 | Busch et al. | 73/6 |
| 4,083,222 | 4/1978 | Stawiski | 73/6 |
| 4,187,518 | 2/1980 | Martin et al. | 368/47 |

*Primary Examiner*—Vit W. Miska

[57] ABSTRACT

An electronic watch including a watch circuit and display is provided which additionally includes an automatic time indication modifier. The modifier comprises a receiver, a filter for passing only that component of the signal from the receiver which has the same frequency as a time announcement signal, a pulse height discriminator for converting an output signal of the filter into a bi-level signal in accordance with the magnitude of the output signal above a threshold level, a time announcement pattern discrimination circuit responsive to the bi-level signal from the discriminator to determine the presence of a time announcement pattern on the basis of the duration of and the time interval between the bi-level signals, and a "seconds" indication modifying and control circuit for modifying a "seconds" indication of the watch in response to an output signal from the discrimination circuit.

17 Claims, 12 Drawing Figures

ELECTRONIC WATCH WITH AN AUTOMATIC TIME INDICATION MODIFIER

BACKGROUND OF THE INVENTION

The invention relates to an electronic watch in which the "seconds" indication of the watch is automatically corrected by detecting a time announcement given by a radio or television receiver, and more particularly, to such arrangement where an audio signal from a receiver is fed to a band pass filter to derive a signal of a frequency which corresponds to a time announcement signal comprising a burst of signals and in which the duration of and the time interval between the filtered signals is determined in a digital manner by a time announcement pattern discriminator using a reference clock in order to decide whether the received signal represents a desired time announcement signal, the "seconds" indication of a watch being automatically corrected in accordance with the time announcement by utilizing a 30 seconds over-center reset circuit whenever the signal is determined to be a regular time announcement signal.

An electronic watch which utilizes a quartz oscillator as an oscillator source has a high level of frequency stability in providing a reference oscillation signal. A time error is within ±5 to 15 seconds per month, and hence a correct time indication can be maintained if the "seconds" indication is corrected at least once per month. However, with conventional electronic watches, a reset operation of "seconds" indication or the start of running after the time modification takes place by a manual operation of a button switch of the watch in timed relationship with a time announcement which is produced by a radio or television receiver. This manual operation is cumbersome and may cause a mistaken timing adjustment very frequently.

While there is a proposal for the provision of an electronic watch in which a time modification is automatically performed by detecting a time announcement from a radio or television receiver, it remains to be theoretical only, and involves practical difficulties. These difficulties are caused by the fact that a microphone must be used to pick up a time announcement signal, but may also pick up environmental noises or ticking sound of the watch itself. In order to determine if the signal picked up represents a time announcement signal, the entire pattern of the time announcement signal must be recognized. There has been available no discrimination circuit which exhibits a good immunity from noises and assures a reliable detection of a time announcement pattern and which is suitable to be incorporated into an electronic watch. The discrimination, if possible at all, is limited to a single time announcement pattern, and is not amenable to a generalized use.

SUMMARY OF THE INVENTION

Therefore, it is a principal object of the invention to provide an electronic watch with an automatic time indication modifier which enables a correct modification of "seconds" indication in accordance with a time announcement through a reliable and facilitated determination of a time announcement pattern signal from a received signal.

It is another object of the invention to provide an electronic watch with an automatic time indication modifier in which only a signal having the same frequency as a time announcement signal is derived from a signal that is received by a receiver such as a microphone, and is converted into a bi-level signal which is then subject to a determination of the duration and the time interval thereof in order to discriminate a time announcement pattern and to provide a signal at a correct time which operates a 30 seconds over-center reset circuit to provide an automatic modification of "seconds" indication and a starting of running of the watch circuit.

It is a further object of the invention to provide a time announcement detecting apparatus which is suitable for use in an electronic watch of an automatic time indication modification type and in which a time announcement pattern is recognized on the basis of a determination of the duration of and the time interval between time announcement signals received, by utilizing a reference signal and in which a dead period is provided in the region of the falling edge of the time announcement signal which prevents a counting operation which is used for the purpose of recognizing the time announcement pattern from being interrupted, thereby preventing any transient distortions near the falling edge of the time announcement signal from interfering with a reliable detection of the time announcement.

It is still another object of the invention to provide a time announcement signal discrimination circuit which exhibits an improved immunity from noises, assures a reliable recognition of a time announcement pattern and facilitates the implementation in an electronic watch.

It is a still further object of the invention to provide a time announcement signal discrimination circuit which assures a reliable detection of a time announcement pattern and which can be used with a plurality of different time announcement patterns.

It is an additional object of the invention to provide an electronic watch in which a band pass filter is formed by an integratable, high accuracy switched capacitor filter which is clocked from the oscillator source of the watch or from a frequency divider associated therewith.

Above and other objects of the invention will become apparent from the following description given in connection with the drawings.

DETAILED DESCRIPTION OF AN ILLUSTRATIVE EMBODIMENT

Figure 1:
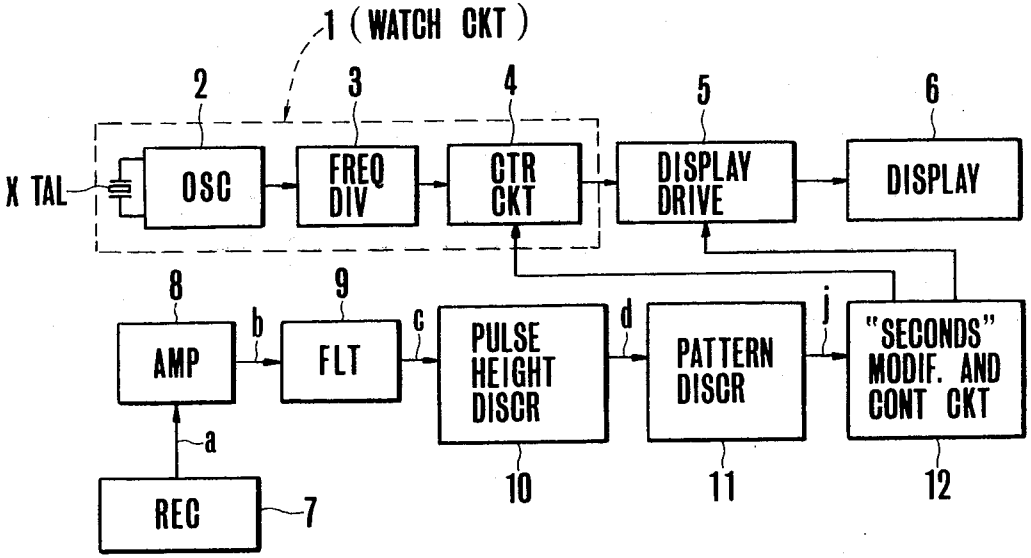
FIG. 1 is a block diagram of an electronic watch with an automatic time indication modifier according to the invention.

Referring to FIG. 1, there is shown a block diagram of an electronic watch according to the invention. A watch circuit is generally shown by numeral 1, and may comprise an oscillator 2 which utilizes a quartz oscillator Xtal, for example, a frequency divider 3 which divides the oscillation output into pulses having a period of one second, and a counter circuit 4 which responds to the one second pulses by providing a second, a minute, an hour, and a day count. These counts are fed through a display driver 5 (see U.S. Pat. No. 3,781,864) to be displayed by a display 6. The display 6 may comprise a digital display which utilizes a liquid crystal, for example. The construction of such watch circuit 1 is well known in the art, and specific examples thereof can be found in U.S. Pat. Nos. 3,948,036, 3,967,442 and 3,889,460.

In accordance with the invention, there is provided a receiver 7 for receiving a time announcement signal. The receiver 7 feeds an amplifier 8, and the amplified signal is passed into a band pass filter 9, which may comprise an active filter comprising an operational amplifier, a switched capacitor filter or the like. The filter 9 is arranged to pass a frequency of 440 Hz which corresponds to a notice signal of a time announcement signal. When an active filter is used for the filter 9, the Q-value thereof is chosen to minimize transient distortions for the rising and the falling edge of the signal frequency passed therethrough, in particular for the notice signal. By way of example, for a notice signal of a time announcement signal which is transmitted by NHK (Broadcasting Corporation of Japan), the filter 9 has a Q value which is less than 140.

The switched capacitor filter is formed of MOS transistors, capacitors and an operational amplifier which can be formed as an integrated circuit, and a clock frequency for the switching operation of such filter is supplied from the frequency divider 3.

The output of the filter 9 is fed to a pulse height discriminator 10, which discriminates a signal level from the filter 9 above a given level to provide a bi-level pulse signal of a frequency of 440 Hz for application to a time announcement pattern discrimination circuit 11. The purpose of the discrimination circuit 11 is to recognize a time announcement pattern (or a notice signal pattern) contained in the output signal from the pulse height discriminator 10 to deliver a pulse in accordance with the result of the recognition which is subsequently fed to a "second" modifying control circuit 12. In response thereto, the control circuit 12 operates to correct the digital "second" count in the counter circuit 4 at the correct time of the time announcement. The arrangement of the "second" modifying circuit 12 is known, and is disclosed, for example, in U.S. Pat. Nos. 3,948,036 and 3,889,460.

Figure 2:
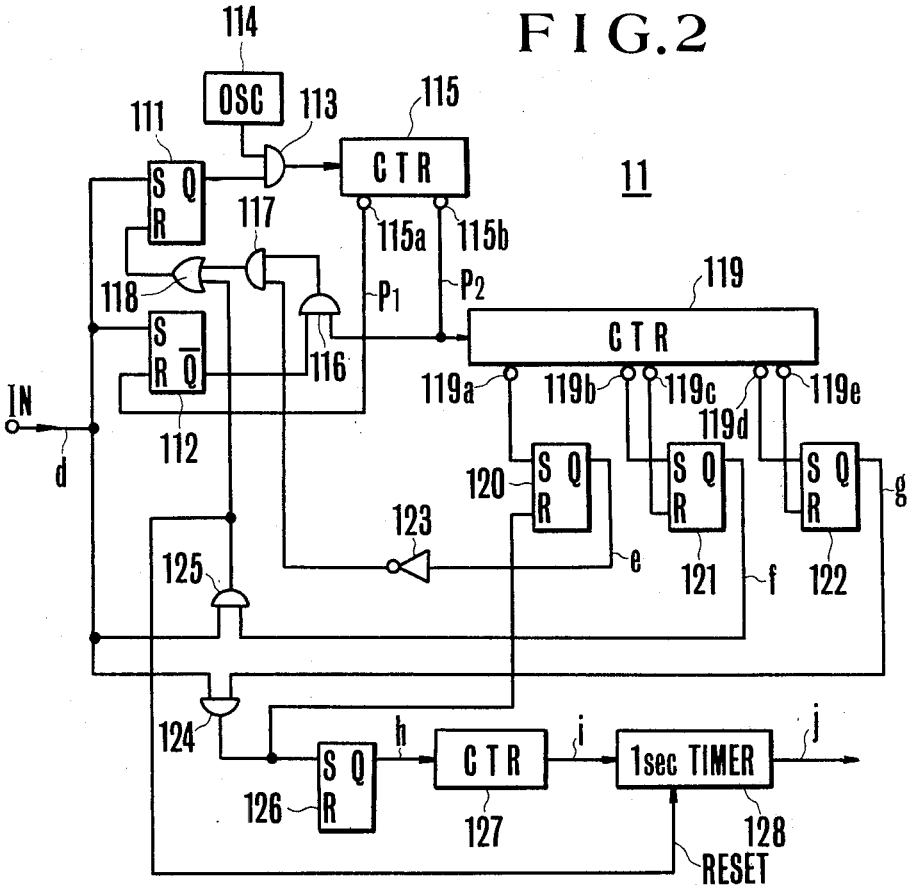
FIG. 2 is a circuit diagram illustrating one form of a time announcement pattern discrimination circuit shown in FIG. 1.

The recognition of the time announcement pattern by the discrimination circuit 11 takes place by determining the duration of and the time interval between the output signals (burst signals) from the discriminator 10, and a specific circuit arrangement is shown in FIG. 2.

Referring to FIG. 2, there is shown an input terminal IN adapted to receive a time announcement signal by connection with the output of the pulse height discriminator 10. A pair of flipflops 111, 112 have their set terminals S connected with the input terminal IN. Q output of the flipflop 111 is fed to one input of AND gate 113 to enable it, thus passing a clock pulse of 1024 Hz, for example, from a source of reference signal 114 to a counter 115. The source 114 utilizes the frequency divider circuit of the electronic watch. The counter 115 has a pair of terminals 115*a*, 115*b* which deliver pulse signals at a desired time interval. (The time interval may be on the order of about 3 ms for a time announcement signal broadcast by NHK since the notice signal has a frequency of 440 Hz and a duration of 100 ms.) An output signal from the terminal 115*a* is applied to the reset terminal R of the flipflop 112 while an output signal from the terminal 115*b* is fed to one input of AND gate 116 which receives its other input from $\overline{Q}$ output from the flipflop 112. The counter 115 has a counting capacity of four, and produces an output pulse at its terminal 115*a* in response to the first clock pulse received and an output pulse at its terminal 115*b* in response to the fourth clock pulse received. The output of AND gate 116 is fed to one input of AND gate 117 and thence through OR gate 118 to the reset terminal R of the flipflop 111. In this manner, the flipflops 111, 112, the counter 115, AND gates 113, 116, 117 and OR gate 118 constitute together a circuit which determines if the input signal continues for a given time interval as occurs with a notice signal (burst signal).

The output signal from the terminal 115*b* of the counter 115 is also fed to another counter 118 which is provided with a plurality of output terminals 119*a* to 119*e* from which a pulse signal is sequentially produced when the count in the counter 119 reaches values corresponding to the width or the interval of a burst signal such as a notice signal which defines a time announcement pattern. The terminal 119*a* is connected with the set terminal S of a flipflop 120, and the terminals 119*b*, 119*c* are connected with the set and the reset terminal S, R of a flipflop 121 while the terminals 119*d*, 119*e* are connected with the set and the reset terminal S, R of a flipflop 122.

By being inverted by signals fed from the counter 119, the flipflops 120 to 122 constitute together circuit means which determines if the width and the interval of the input signals correspond to those of a time announcement pattern. Q output of the flipflop 120 is fed through an inverter 123 to the other input of AND gate 117. Q output of the flipflop 122 is applied to one input of AND gate 124 which receives its other input from the input terminal IN. The logical product output of AND gate 124 is applied as a reset input to the flipflop 120. Q output of the flipflop 121 is applied to one input of AND gate 125 which receives its other input from the input terminal IN and the output of which is fed to OR gate 118.

An output "H" (indicating a high level output) from AND gate 124 is applied to the set terminal S of a flipflop 126, Q output of which is connected with the input of a burst signal (notice signal) counter 127. When the counter 127 has accumulated count which corresponds to the number of the notice signals contained in the time announcement pattern, it feeds a signal to a one second timer 128, which delivers a pulse output one second after the reception of the signal from the counter. The timer 128 is reset by "H" signal from AND gate 125.

Figure 3:
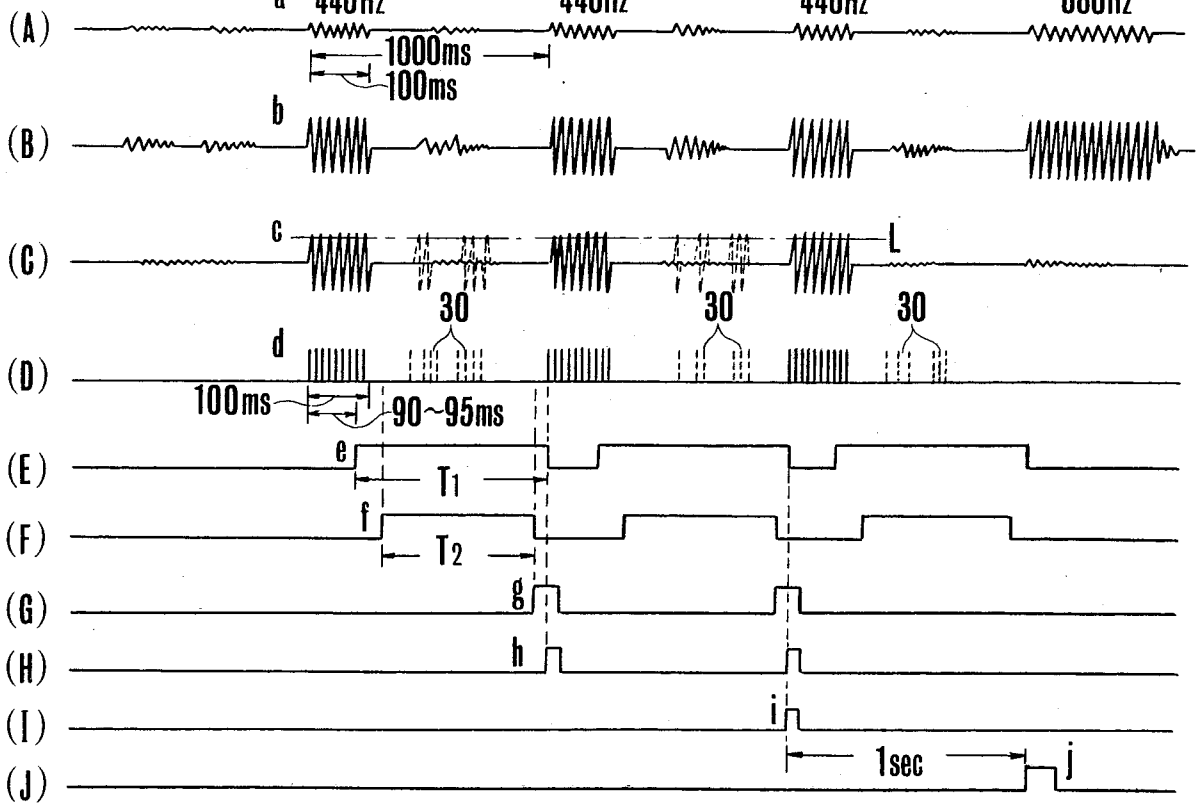
FIG. 3 graphically shows a series of waveforms which appear in various parts of FIG. 2.

Referring to FIGS. 1 to 4, the operation of the circuit arrangement shown in FIG. 2 will be described. When the receiver 7 receives a time announcement signal, it delivers an output signal, containing noises, of a pattern as indicated in graph A of FIG. 3 and which comprises three bursts or notice signals of 440 Hz, repeated at the time interval of one second and each lasting for a time duration of 100 ms, and a correct time signal of 880 Hz. This output signal is amplified by the amplifier 8 as shown in graph B of FIG. 3. The fiter 9 only passes the same frequency component as the notice signal (440 Hz) whereby a waveform as indicated by graph C of FIG. 3 is derived for application to the pulse height discriminator 10. In response to the input signal shown in FIG. 3C, the discriminator 10 converts a portion of this signal which is above a given level L into a bi-level signal shown in FIG. 3D.

When the bi-level signal is supplied to the input terminal IN of the time announcement signal discrimination circuit 11, the flipflops 111, 112 are set by the bi-level signal, and the Q output of the flipflop 111 enables AND gate 113. Accordingly, a clock pulse from the source 114 is passed therethrough to be fed to the counter 115. As the counter 115 counts up, pulses are delivered from the terminals 115*a*, 115*b* in a manner illustrated in FIGS. 4B and C. Specifically, when a signal $P_1$ is delivered, the flipflop 112 is reset. As 3 ms after the delivery of the signal $P_1$ from the terminal 115*a*, the other terminal 115*b* delivers a signal $P_2$. If there is no input signal to the terminal IN during this time interval, the $\overline{Q}$ output of the flipflop 112 and the signal $P_2$ from the terminal 115*b* causes AND gate 116 to produce an "H" output, which is applied through AND gate 117 and OR gate 118 to the reset terminal of the flipflop 118, thereby resetting it. Thereupon AND gate 113 is disabled to prevent clock pulses from being fed to the counter 115. In other words, the signal which has been applied to the input terminal IN is determined to be a noise component rather than a signal such as a notice signal which occurs at a time interval of 1/440 sec. If there is an input signal a during the time interval of 3 ms between the signals $P_1$ and $P_2$, as shown in FIG. 4A, the flipflop 112 which has been reset by the signal $P_1$ from the terminal 115*a* is immediately set by this input signal to maintain "L" level at its $\overline{Q}$ output, whereby the flipflop 111 cannot be reset, thus continuing to feed the clock pulses to the counter 115 if the signal $P_2$ from the counter terminal 115*b* is supplied to AND gate 116 which is then disabled. This provides a determination if the input signal occurs in succession for a duration of 100 ms as will occur for a notice signal of the time announcement signal.

On the other hand, the signal $P_2$ from the counter terminal 115*a* is counted by the counter 119 which will deliver a signal e (see FIG. 3E) at its terminal 119*a* at a timing which is shortly before the falling edge of the input signal occurring in succession as indicated in FIG. 3D, such as the notice signal of the time announcement pattern, this timing being from 90 to 95 ms from the beginning of the input signal. The signal e is applied to the set terminal of the flipflop 120, the Q output of which then assumes an "H" level. The "H" level is maintained for a time interval $T_1$ (see FIG. 3E) until the rising edge of the succeeding notice signal. The Q output of the flipflop 120 is changed into an "L" level by the inverter 123, so that the flipflops 111, 112 and the counter 115 no longer function to determine the width or duration of the burst after they have cooperated together to detect a first one of the notice signals. Subsequently, the flipflop 111 is maintained set to pass clock pulses from the source 114 to the counter 115 independently from the presence or or absence of an input signal to the input terminal IN. A signal f is delivered from the counter terminal 119*b* a given time interval after the delivery of the signal from the terminal 119*a*, or shortly after the falling edge of the notice signal, thereby setting the flipflop 121 to raise its Q output to "H" level (see FIG. 3F) to enable AND gate 125. The interval $T_2$ during which the flipflop 121 remains set continues to a point in time shortly before the appearance of the next notice signal. When the next notice signal appears, the counter terminal 119*c* delivers a signal which resets the flipflop 121.

If an input signal (principally noises) is applied to the input terminal IN during the time interval $T_2$ when the flipflop 121 remains set, that is, from the appearance of the first notice signal to a point in time shortly before the appearance of the second notice signal, during which time the function of determining a burst is quiescent, AND gate 125 produces an "H" level output which is fed through OR gate 118 to reset the flipflop 111, thus interrupting the supply of the clock pulses to the counter 115. This provides a determination that the input signal does not have an interval (900 ms) between successive signals which are normally contained in a time announcement pattern, and hence represents a noise component. With a regular time announcement pattern, there will be no signal which occurs between the notice signals, so that the flipflop 111 cannot be reset, thereby allowing the continued operation of the counter 115. When the flipflop 121 is reset by the signal from the counter terminal 119*c*, the counter terminal 119*d* simultaneously produces a signal which sets the flipflop 122, raising its Q output to an "H" level (see FIG. 3G). If an input signal to be expected, namely, the next (the second) notice signal is supplied to the discrimination circuit 11 during the time this Q output remains at its "H" level, the logical product of the notice signal and Q output of the flipflop 122 produces an "H" output from AND gate, thereby setting the flipflop 126 to feed a count signal h to the counter 127 and simultaneously resetting the flipflop 120 to cause its Q output to revert to an "L" level.

When the described operation is repeated in accordance with the pattern of three notice signals shown in FIG. 3D, a determination is made that it represents a regular time announcement signal. Specifically, the counter 127 delivers a signal i (see FIG. 3I) at the rising edge of a third notice signal. In response thereto, the timer 128 operates to deliver a pulse j (see FIG. 3J) one second later unless the supply of clock pulses to the counter 115 is interrupted, that is, if the input signal occurs in succession during a time duration of about 100 ms and ceases to appear for a time interval of about 900 ms. The pulse j is introduced into the "Seconds" modification circuit 12. The modification circuit 12 operates to round up any count in the "seconds" counter of the counter circuit 4 which is greater than 30 (representing a lagging condition) to one minute to adjust the time indication at the correct time of the time announcement, and to round off the count to zero if the count therein is less than 30 (an advanced condition).

It will be seen that the described embodiment achieves a re-adjustment of a "seconds" indication with a high accuracy, thus eliminating a troublesome manual operation to re-adjust the "seconds" indication. Since the time announcement pattern discrimination circuit is formed as a digital circuit, the circuit arrangement is simplified and provides a reliable operation. In addition, it can be implemented into an electronic watch as an integrated circuit element. It should be understood that the receiver 7 which is used in the embodiment of FIG. 1 to pick up a time announcement signal may be replaced by a microphone. Because the arrangement is to be incorporated into an electronic watch, it is preferred to use a miniature microphone of piezoelectric or electret type.

Figure 5:
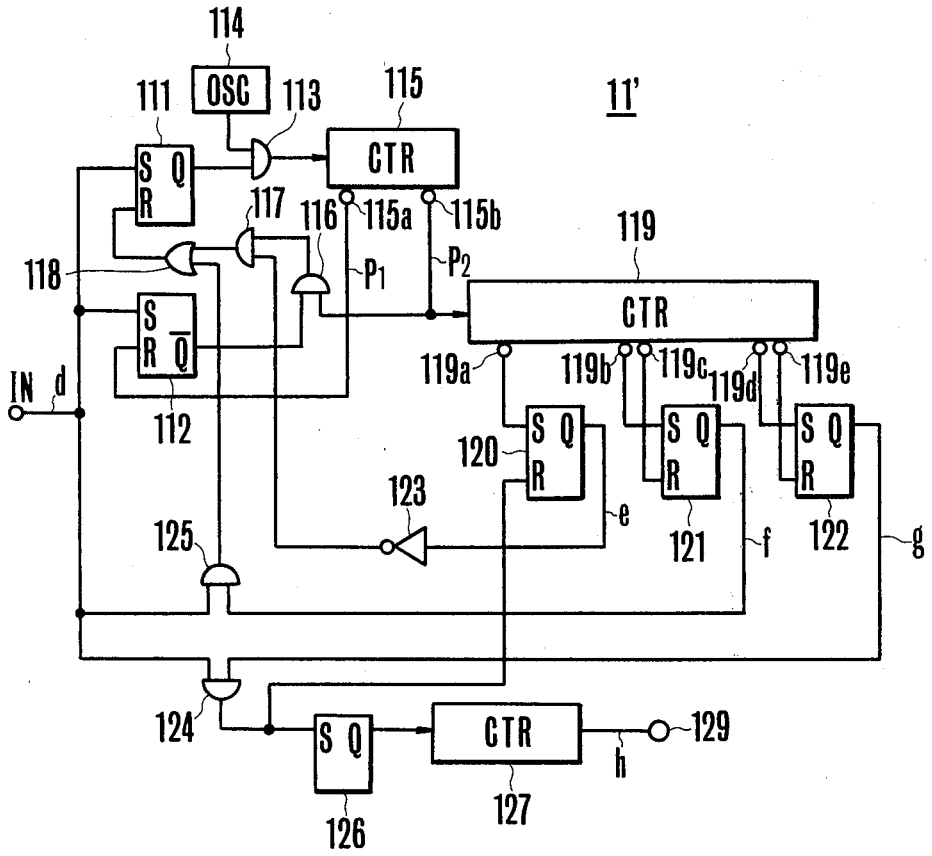
FIG. 5 is a circuit diagram of another form of time announcement pattern discrimination circuit shown in FIG. 1.

FIG. 5 shows another embodiment of the time announcement pattern discrimination circuit which may be used when a microphone is used to pick up a time announcement signal. As mentioned previously, a time announcement signal pattern emitted by NHK comprises three notice signals having a frequency of 440 Hz and a duration of 100 ms and spaced apart by one second, and a correct time signal of 880 Hz which follows the last notice signal one second later, as shown in FIG. 3A. A problem with the use of a microphone which is internally housed within a watch to pick up a time announcement signal is the fact that when the signal is supplied to the time announcement signal discrimination circuit, the response of the microphone, the reverberation effect and the response of the filter may cause transient distortions in the falling edge of the signal, as illustrated in FIG. 6D. This results in the notice signal which lasts over a normal time interval of 100 ms, causing inaccuracies in the determination whether the signal is a regular time announcement signal or noises.

The time announcement pattern discrimination circuit 11' shown in FIG. 5 is directed to overcoming this problem. It is to be understood that similar elements as shown in FIG. 2 are designated by like reference characters in FIG. 5. The principal distinction from the arrangement of FIG. 2 is that in the arrangement of FIG. 5, a dead period is provided which prevents the counter operation from being interrupted in the region of the falling edge of the time announcement signal, thereby enabling a reliable discrimination of a time announcement pattern independently from any transient distortion present in the region of the falling edge of the time announcement signal.

Figure 4:
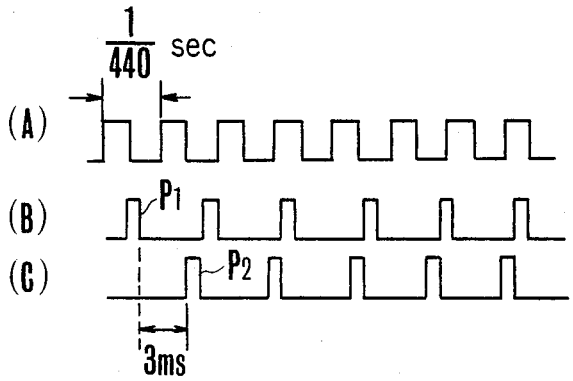
FIG. 4 graphically shows several pulses which appear in the circuit arrangement of FIG. 2.
Figure 6:
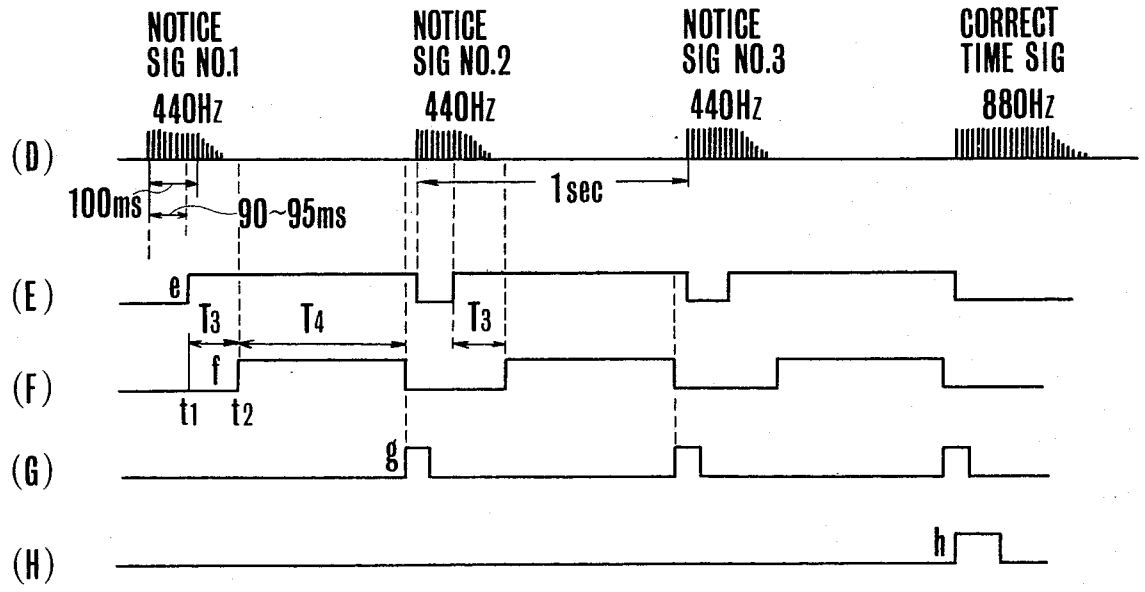
FIG. 6 graphically shows various waveforms which appear in various parts of FIG. 5.

Specifically, referring to FIGS. 5 and 6 together with FIG. 4, when an output signal from the pulse height discriminator 10 is applied to the input terminal IN, the flipflops 111, 112 are set as before. The Q output of the flipflop 111 enables AND gate 113, thus passing clock pulses from the source 114 to the counter 115. As the counter 115 counts up, its terminals 115*a*, 115*b* deliver the output signals $P_1$, $P_2$ which are related to each other in the manner illustrated in FIGS. 4B and C. The output signal $P_1$ is applied to the reset terminal R of the flipflop 112 to reset it. If there is no input signal from the delivery of the output signal $P_1$ from the terminal 115*a* until the delivery of the output signal $P_2$ from the terminal 115*b* which occurs 3 ms later, the combination of the signal $P_2$ and the $\overline{Q}$ output of the flipflop 112 causes an "H" level output to be produced from AND gate 116, which is passed through AND gate 117 and OR gate 118 to reset the flipflop 111. Consequently, AND gate 113 is disabled, ceasing to feed clock pulses to the counter 115. This represents a determination that the signal supplied to the input terminal IN is not a time announcement signal (notice signal). On the other hand, if there is an input signal a (see FIG. 4A) during the 3 ms interval, the flipflop 112, after it has been reset by the signal $P_1$, is immediately set by the input signal. The flipflop 111 is maintained set to enable the clock pulses to be fed to the counter 115 if the signal $P_2$ is delivered from the terminal 115*b* 3 ms later and applied to one input of AND gate 116 inasmuch as the $\overline{Q}$ output of the flipflop 112 remains in its "L" level. This operation provides a determination if a signal applied to the input terminal IN occurs in succession, namely, if it is a notice signal of the time announcement pattern.

On the other hand, the output from the counter terminal 115*b* is supplied to the input of the counter 119, the terminal 119*a* of which delivers a signal to set the flipflop 120 (see FIG. 6E) shortly before a time $t_1$ corresponding to the falling edge of the input signal such as the notice signal of the time announcement pattern which occurs in succession as shown in FIG. 6D. In other words, the time $t_1$ is from 90 to 95 ms after the beginning of the notice signal. The Q output of the flipflop 120 is inverted into an "L" level by the inverter 123, whereby the flipflop 111 is maintained set independently from the presence or absence of an input signal to the input terminal IN, thus continuously supplying clock pulses from the source 114 to the counter 115. At a given time after the time $t_1$ when the signal is delivered from the terminal 119*a*, or at time $t_2$ when transient distrotions which might occur in the region of the falling edge of the notice signal have completely been relinquished (dead period $T_3$), the counter terminal 119*b* delivers a signal to set the flipflop 121 to raise its Q output to an "H" level (see FIG. 6F), thus enabling AND gate 125.

During the dead period $T_3$, the clock pulses are fed to the counter 115 independently from the presence or absence of any input signal including transient distortions, thus allowing it to continue its operation to discriminate a time announcement pattern. The flipflop 121 remains set to a point in time which is shortly before the appearance of the next notice signal as shown in FIG. 6F. When this period $T_4$ lapses, the counter terminal 119*c* delivers a signal to reset the flipflop 121.

When an input signal is applied to the input terminal IN during the period $T_4$ when the flipflop 121 remains set, the output of AND gate 125 assumes an "H" level, and is fed through OR gate 118 to reset the flipflop 111, thus interrupting the supply of clock pulses to the counter 115. This provides a determination that the signal supplied to the input terminal does not have a time interval between the signals which coincide with those of the time announcement pattern, thus clearing the counters 115, 119.

However, with the regular time announcement pattern, there is no signal present between the successive notice signals and the flipflop 111 cannot be reset, so that the counters 115, 119 continue to operate. When the flipflop 121 is reset by the signal from the terminal 119*c*, the flipflop 122 is simultaneously set by a signal from the counter terminal 119*d*, whereby its Q output is raised to an "H" level as shown in FIG. 6G. The "H" output continues until the flipflop 122 is reset by a signal from the terminal 119*e* which is produced slightly after the rising edge of the next following notice signal. If an expected input signal or next following notice signal (which is the second) is supplied to the terminal IN during the time the flipflop 122 is set, the logical product of this notice signal and the Q output of the flipflop 122 causes AND gate 124 to produce an "H" output, which sets the flipflop 126, thereby supplying a count signal to the counter 127. Simultaneously, this output resets the flipflop 120, the Q output of which is inverted to the "H" level by the inverter 123 to enable AND gate 117 so that the output from the AND gate 116 can be passed to the flipflop 111.

The same operation is repeated for the three successive notice signals and a single correct time signal, which constitute together the time announcement pattern as shown in FIG. 6D, and thereupon a determination is rendered that the input represents the resular time announcement pattern. Accordingly, the counter 127 produces a control signal at its output terminal 128 (see FIG. 6H) in synchronized relationship with an input signal representing the correct time signal in order to modify the time indication of the watch.

Figure 7:
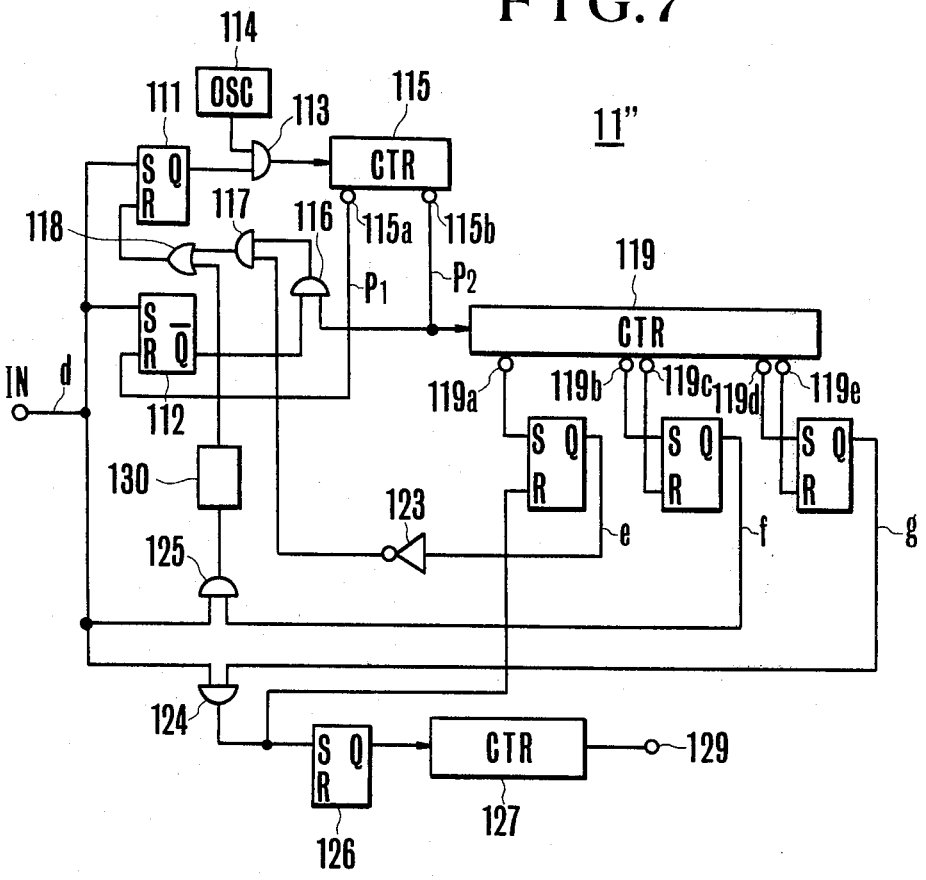
FIG. 7 is a circuit diagram of a further form of time announcement pattern discrimination circuit of FIG. 1.

FIG. 7 shows another embodiment of the time announcement pattern discrimination circuit 11 shown in FIG. 1 in which the immunity from noises is further improved to enhance the accuracy of recognition of the time announcement pattern. The principal difference of the discrimination circuit 11" of this embodiment over the discrimination circuit 11 of FIG. 2 is the provision of a counter 130 between AND gate 125 and OR gate 118 while remaining elements are designated by like reference characters as before. The counter 130 operates to feed a signal to OR gate 118 to reset the flipflop 111 to thereby cease the supply of clock pulses to the counter 115 in the event noise components which are counted by the counter 130 after AND gate 125 is opened by the Q output of the flipflop 121 for an interval which is shorter than the time interval between successive notice signals reach a given permissible value.

Specifically, when an input signal (principally noises) 30 shown in broken lines in FIG. 3D is applied to the input terminal IN during the time interval $T_2$ when the flipflop 121 is set, that is, between the cessation of a first notice signal and a point shortly before the appearance of the second notice signal during which time the function of the circuit arrangement to determine the time announcement pattern is interrupted, this signal is passed through AND gate 125 to be counted by the counter 130. When a count exceeds a given permissible value, the counter 130 delivers an output which is passed through OR gate 118 to reset the flipflop 111, thus disabling AND gate 113 to cease the supply of clock pulses to the counter 115. In this manner, a determination is rendered that this signal does not represent a time announcement signal. If the number of inputs counted by the counter 130 during the time interval $T_2$ does not exceed the permissible value, the flipflop 111 is not reset, so that the counters 115, 119 continue their operation to discriminate the time announcement pattern.

The purpose of this arrangement is to provide a guard against the likelihood that as the microphone picks up the time announcement signal, any percussion or talking sound may be picked up which may be continuous in nature in the same manner as the burst signal to cause a mistaken determination that it also represents a time announcement signal. A given permissible value is determined by the counter 130 in order to exclude the possibility that the existence of a single noise pulse during the time interval $T_2$ may result in an erroneous determination that the real time announcement signal is absent.

Figure 8:
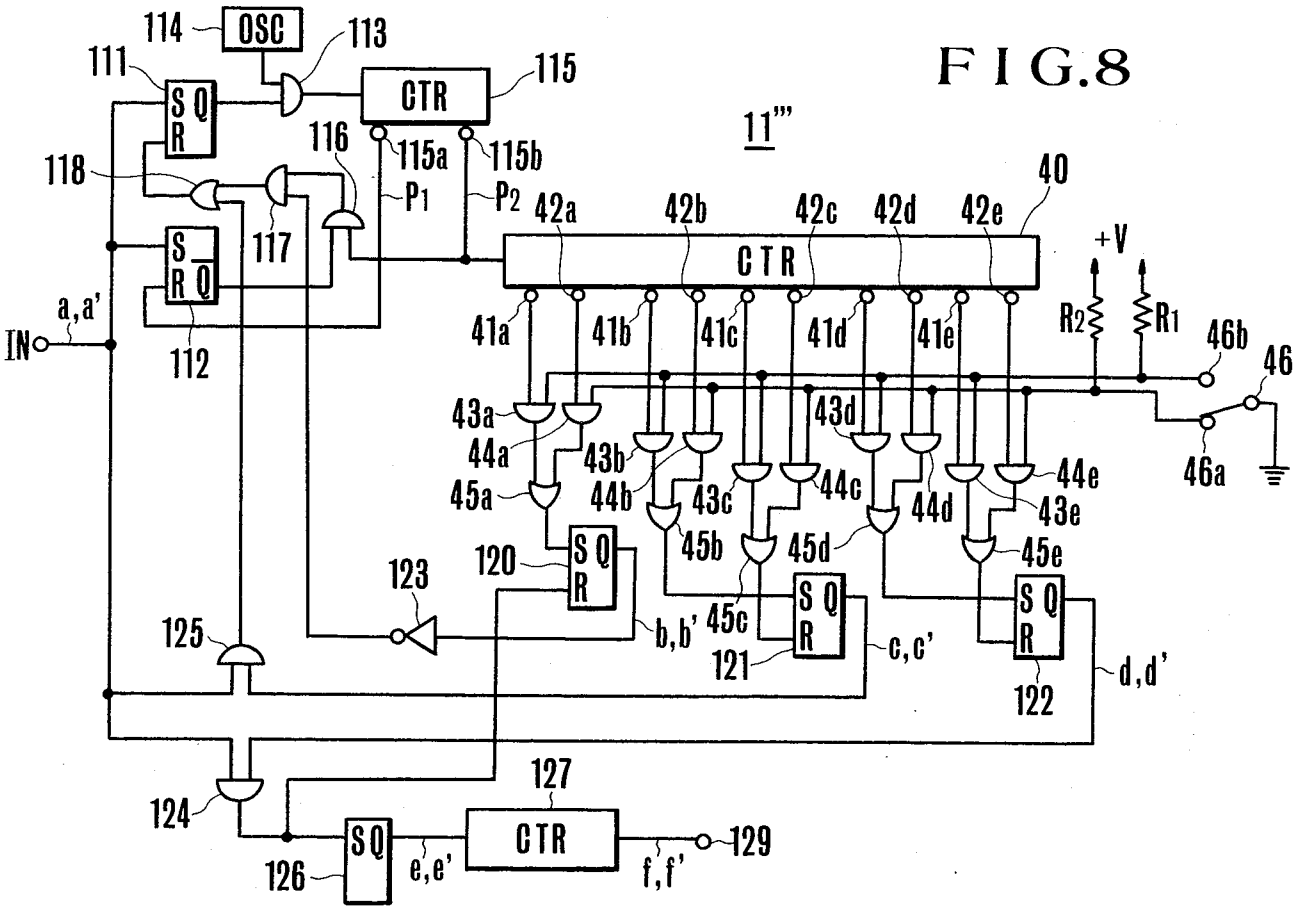
FIG. 8 is a circuit diagram illustrating still another form of time announcement pattern discrimination circuit of FIG. 1.

FIG. 8 shows a further embodiment of time announcement pattern discrimination circuit 11''' which enables two different kinds of time announcement patterns to be discriminated from each other. Parts corresponding to those shown in FIG. 2 are designated by like reference characters. The principal difference over the arrangement of FIG. 2 is the provision of a counter 40 which counts a signal from the counter 115, and a logic circuit which operates to set or reset the flipflop 120, 121, 122 in response to a signal from the counter 40.

The counter 40 includes a plurality of terminals 41*a* to 41*e* which are utilized in determining a time announcement pattern broadcast by NHK, for example, and also another plurality of terminals 42*a* to 42*e* which are utilized to determine a time announcement pattern emitted by the Telegraph and Telephone Corporation of Japan. It will be appreciated that the terminals 41*a* to 41*e* sequentially deliver pulses when the count in the counter 40 reaches values which correspond to the duration and the time interval of burst signals (such as notice signals) which constitute together the time announcement pattern broadcast by NHK. Similarly, the terminals 42*a* to 42*e* also sequentially deliver pulses when the count in the counter 40 reaches values corresponding to the duration and the time interval between the burst signals (such as notice signals) which constitute together the time announcement pattern emitted by the Telegraph and Telephone Corporation of Japan.

Specifically, the terminal 41*a* is connected with one input of AND gate 43*a* which has its output connected through OR gate 45*a* with the set terminal S of the flipflop 120. The terminal 41*b* is connected with one input of AND gate 43*b* which has its output connected through OR gate 45*b* with the set terminal S of the flipflop 121. The terminal 41*c* is connected with one input of AND gate 43*c* which has its output connected through OR gate 45*c* with the reset terminal R of the flipflop 121. The terminal 41*d* is connected with one input of AND gate 43*d* which has its output connected through OR gate 45*d* with the set terminal S of the flipflop 122. Finally, the terminal 41*e* is connected with one input of AND gate 43*e* which has its output connected through OR gate 45*e* with the reset terminal R of the flipflop 122. In the similar manner, the terminal 42*a* is connected through AND gate 44*a* and OR gate 45*a* with the set terminal S of the flipflop 120; the terminals 42*b* and 42*c* are connected through AND gates 44*b*, 44*c* and OR gates 45*b*, 45*c* with the set terminal S and the reset terminal R of the flipflop 121; and the terminals 42*d* and 42*c* are connected through AND gates 44*d* and 44*e* and OR gates 45*d* and 45*e* with the set terminal S and the reset terminal R of the flipflop 122. The other input of AND gates 43*a* to 43*e* is supplied with a voltage +V through a common resistor R1 while the other input of AND gates 44*a* to 44*e* is supplied with a voltage +V through a common resistor R2. Junction 46*a* between the resistor R2 and the other input of AND gates 44*a* to 44*e* as well as the junction 46*b* between the resistor R1 and the other input of AND gates 43*a* to 43*e* may be selectively connected with the ground through a switch 46 which may be operated externally of the watch.

Figure 9:
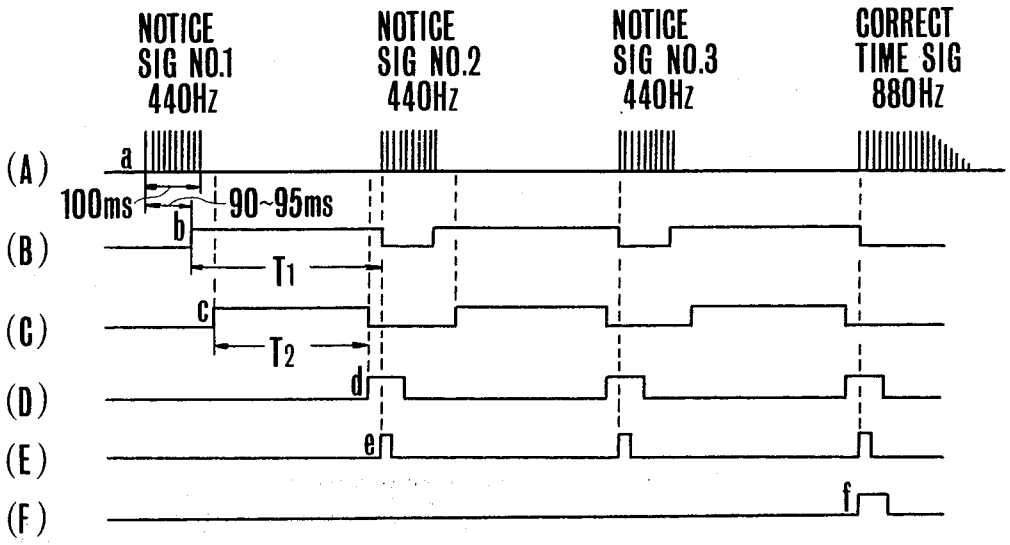
FIGS. 9 and 10 show various waveforms which appear in the circuit arrangement of FIG. 8.

In operation, considering first the discrimination of the time announcement pattern of NHK, the switch 46 is thrown to the contact 46*a*, thus disabling AND gates 44*a* to 44*e* by connection with the ground ("L"). As shown in FIG. 9A, the time announcement pattern of NHK comprises three notice signals of 440 Hz and having a duration of 100 ms and a correct time signal of 880 Hz. When the output signal from the pulse height discriminator 10 is applied to the input terminal IN, the both flipflops 111, 112 are set, with the "H" level Q output of the flipflop 111 enabling AND gate 113. Hence, clock pulses from the source 114 can be fed therethough to the counter 115. As the counter 115 counts these clock pulses, its terminals 115*a* and 115*b* deliver pulses $P_1$, $P_2$ in the manner as illustrated in FIGS. 4B and 4C. The signal $P_1$ reset the flipflop 112. If there is no input signal during a time interval of 3 ms after the delivery of the signal $P_1$ from the terminal 115*a* and before the signal $P_2$ is delivered from the terminal 115*b* (since the interval between pulses of a notice signal is equal to 1/440=2.3 ms), the combination of the signal $P_2$ and the $\overline{Q}$ output of the flipflop 112 causes AND gate 116 to produce an "H" output, which is fed through AND gate 117 and OR gate 118 to reset the flipflop 111. In this manner, AND gate 113 is disabled, ceasing to supply clock pulses to the counter 115. This represents a determination that the signal applied to the input terminal IN is not the regular notice signal which includes pulses occurring at the time interval of 1/440 ms, but is a noise component. On the other hand, if there is an input signal between the 3 ms interval between the signals $P_1$ and $P_2$, the flipflop 112 which has been reset by the signal $P_1$ is immediately set to maintain an "L" output from AND gate 116, so that the signal $P_2$ which occurs subsequently and is applied to the input of AND gate 116 cannot reset the flipflop 111, which remains set to allow clock pulses to be fed to the counter 115. This determines that the input signal occurs in succession, namely, just in the same manner as the notice signal of the time announcement signal which occurs for a time interval of 100 ms.

The signal $P_2$ from the counter terminal 115*b* is counted by the counter 40, and at a time shortly before the falling edge of the input signal or the notice signal of the NHK time announcement pattern (or at a time of 90 to 95 ms from its beginning), the counter 40 delivers a signal at its terminal 41*a* which is fed through gates 43*a*, 45*a* to set the flipflop 120, thus raising its Q output to an "H" level. This signal b of "H" level continues for a period $T_1$ which lasts to the beginning of the next following notice signal, as indicated in FIG. 9B. The Q output of the flipflop 120 is inverted into an "L" level by the inverter 123, so that the flipflops 111, 112 and the counter 115 cease their function to determine a burst signal after they have detected the first notice signal. Simultaneously, the flipflop 111 is maintained set independently from the presence or absence of an input signal to the terminal IN, allowing clock pulses from the source 114 to be fed to the counter 115. At a desired time after the signal b, or slightly after the falling edge of the notice signal, the counter 40 delivers a signal at its terminal 41*b* which is fed through gates 43*b*, 45*b* to set the flipflop 121, which has its Q output raised to an "H" level (see FIG. 9C), thus enabling AND gate 125. The flipflop 121 remains set for a time interval $T_2$ which lasts to a point shortly before the appearance of the next notice signal. At such time, the counter 40 delivers a signal at its terminal 41*c* which is fed through gates 43*c*, 45*c* to reset the flipflop 121.

If an input signal (principally noises) appears at the terminal IN during the time interval $T_2$ or after the cessation of the first notice signal and shortly before the appearance of the second notice signal, the output of AND gate 125 changes to an "H" level, which is fed through OR gate 118 to reset the flipflop 111, thus interrupting the supply of clock pulses to the counter 115. This provides a determination that the input signal does not represent a time announcement pattern.

However, when the regular time announcement signal is applied, there is no signal between the notice signals, so that the flipflop 111 cannot be reset, allowing the counters 115 and 40 to continue their operation to determine the time announcement pattern. When the flipflop 121 is reset by the signal from the counter terminal 41*c*, the flipflop 122 is simultaneously set by a signal which is developed at the counter terminal 41*d* and applied thereto through gates 43*d*, 45*d*. An output signal d of a waveform shown in FIG. 9D appears at its Q output. This output is maintained until the flipflop 122 is reset by a signal developed at the counter terminal 41*e* shortly after the rising edge of the next following notice signal. If an expected input signal, that is, the next notice signal (which is the second) arrives at the input terminal IN during this time interval, the logical product of this notice signal and the Q output of the flipflop 122 causes AND gate 124 to produce an "H" level output, which sets the flipflop 126 to cause it to supply a count signal e (see FIG. 9E) to the counter 127. Also, the output of AND gate 124 is applied to the reset terminal of the flipflop 120 to thereby change its Q output to an "L" level which is then inverted to an "H" level by the inverter 123, thus enabling AND gate 117 so as to pass the output of AND gate 116 to the flipflop 111.

When a similar operation is repeated for the signal pattern which comprises the three notice signals and the single correct time signal as illustrated in FIG. 9A, a final determination is rendered that it represents the regular time announcement signal. Accordingly, the counter 127 delivers a time indication modifying pulse f (see FIG. 9F) at its output terminal 129 in synchronism with the correct time signal.

Figure 10:
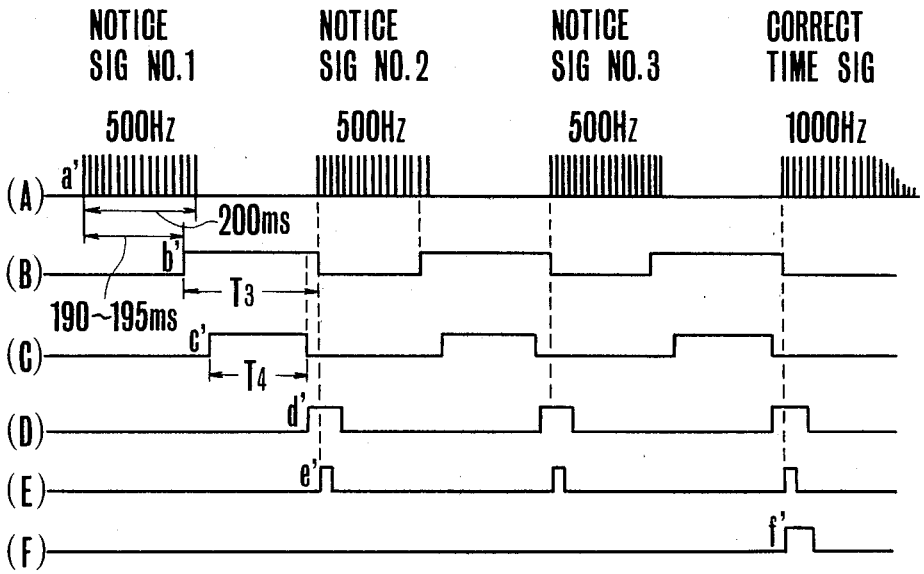

When the discrimination circuit is used to determine the time announcement pattern emitted by the Telegraph and Telephone Corporation of Japan, the switch 46 is thrown to the contact 46*b* to disable AND gates 43*a* to 43*e* by connection with the ground ("L"). The time announcement pattern of the Corporation is shown in FIG. 10A, and comprises three notice signals of 500 Hz and having a duration of 200 ms and a correct time signal of 1000 Hz.

When determining the burst signals of such time announcement pattern, the flipflops 111, 112 and the counter 115 operate generally in the same manner as mentioned above, and hence their description will not be repeated except for a description of principal differences. Specifically, when determining if an input signal occurs in succession for a time interval of 200 ms, the signal $P_2$ from the counter terminal 115*b* is counted by the counter 40, which delivers a signal at its terminal 42*a* at a point shortly before the falling edge of the first notice signal (at time of 190 to 195 ms from the beginning thereof). This signal b′ is fed through gates 44*a*, 45*a* to set the flipflop 120, raising its Q output to an "H" level. The signal b′ is maintained in its "H" level for a time interval $T_3$ which lasts to the beginning of the next following notice signal as shown in FIG. 10B. The Q output of the flipflop is inverted into an "L" level by the inverter 123, whereby the flipflops 111, 112 and the counter 115 cease to determine the burst signal after they have detected the occurrence of the first notice signal. The flipflop 111 is maintained set independently from the presence or absence of an input signal at the the input terminal IN, allowing clock pulses from the source 114 to be fed to the counter 115. At a given time after the occurrence of the signal b', or shortly after the cessation of the falling edge of the first notice signal, the counter 40 delivers another signal at its terminal 42*b* which is fed through gates 44*b*, 45*b* to set the flipflop 121, raising its Q output c' to an "H" level (see FIG. 10C) to enable AND gate 125. The output c' is maintained in its "H" level for a time interval $T_4$ which lasts to a point shortly before the appearance of the next or second notice signal. At such time, the counter 40 delivers a signal at its terminal 42*c* which is fed through gates 44*c* to 45*c* to reset the flipflop 121.

If an input signal (principally noises) appears at the input terminal IN during the time interval $T_4$ when the flipflop 121 remains set, AND gate 125 produces an "H" level output, which is fed through OR gate 118 to reset the flipflop 111, thus interrupting the supply of clock pulses to the counter 115. This provides a determination that the input signal does not correspond to the pattern of the time announcement signal.

On the other hand, with a regular time announcement signal, there occurs no signal between the successive notice signals, so that the flipflop 111 cannot be reset, allowing the counters 115, 40 to continue their operation to determine the time announcement pattern. When the flipflop 121 is reset by the signal from the counter terminal 42*c* which is applied through gates 44*c*, 45*c*, the flipflop 122 is simultaneously set by a signal from the counter terminal 42*d* which is fed through gates 44*d*, 45*d*, with its Q terminal providing an output d' of a waveform shown in FIG. 10D. This output is maintained for a time interval which is terminated when the flipflop 122 is reset by a signal developed at the terminal 42*e* at a point in time which is shortly after the beginning of the next notice signal. If an expected input signal or the second notice signal appears at the input terminal during this interval, the logical product of the notice signal and the Q output of the flipflop 122 causes AND gate 124 to produce an "H" output, which sets the flipflop 126 to supply a count signal e' (see FIG. 10E) to the counter 127. The output signal also resets the flipflop 120, the Q output of which reverts to an "L" level, which is then inverted by the inverter 123 to provide an "H" level signal to enable AND gate 117 so that the output of AND gate 116 may be passed to the flipflop 111.

If a similar operation is repeated for the signal pattern shown in FIG. 10A which comprises three notice signals and a single correct time signal, a final determination is rendered that a regular time announcement signal has been received. Thus, the counter 127 delivers a time indication modifying pulse f' (see FIG. 10F) at its output terminal 129 in synchronism with the occurrence of the correct time signal.

It should be noted that the arrangement of the time announcement signal discrimination circuit of the invention is not limited to specific forms illustrated, but may be modified in various manners. In addition, the circuit arrangement may be modified as required so as to suit any selected time announcement pattern with which the watch is used. In such instance, a selection of a particular time announcement pattern may be made by a switching operation which takes place externally of the watch or by bonding option which takes place internally of the integrated circuit of the watch.

Figure 11:
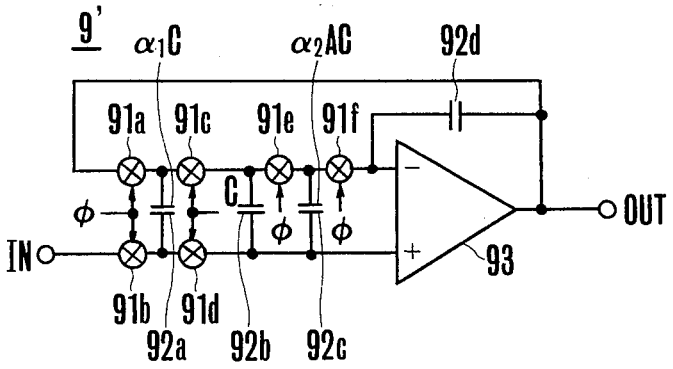
FIG. 11 is a circuit diagram of a switched capacitor filter which may be used as a band pass filter shown in FIG. 1.

FIG. 11 is a circuit diagram of a switched capacitor filter 9' which may be used in place of the band pass filter 9 shown in FIG. 1 to pass the notice signal of 440 Hz. The filter 9' comprises a plurality of switching elements 91*a* to 91*f* which may comprise MOS transistors, a plurality of capacitors 92*a* to 92*d*, and an operational amplifier 93 which may be formed by MOS transistor. Clocks which operate the switching elements 91*a* to 91*f* are derived from the frequency divider 3 shown in FIG. 1. When the filter 9' is used to pass the notice signal of 440 Hz, clocks are utilized which are derived from a frequency divider stage of the frequency divider 3 providing a frequency of 8192 Hz.

The Q value and the central frequency $f_0$ of the filter 9' are defined as follows:

$$\frac{\pi f_0}{Qf_c} = -\tfrac{1}{2}\log\left[k(1+\alpha_1+\alpha_2)\right]$$

$$\frac{\pi f_0}{Qf_c}\cdot\sqrt{4Q^2-1} = \cos^{-1}\left[\frac{k+1}{2\sqrt{k(1+\alpha_1+\alpha_2)}}\right]$$

where $k=(1+\alpha_1)^{-1}(1+A\alpha_2)^{-1}$, and $f_c$ represents the clock frequency.

As indicated by the above expressions, the characteristic of the filter is determined by the ratios of capacitances and the clock frequency along. Thus, when the signal received by the receiver 7 of FIG. 1 is introduced into the filter 9', the switching element thereof are switched by clocks having a frequency of 8192 Hz to provide a satisfactory sampling of the input signal. In this manner, only a signal component of the input signal having a frequency of 440 Hz which corresponds to the notice signal is derived at the output of the filter 9'.

Figure 12:
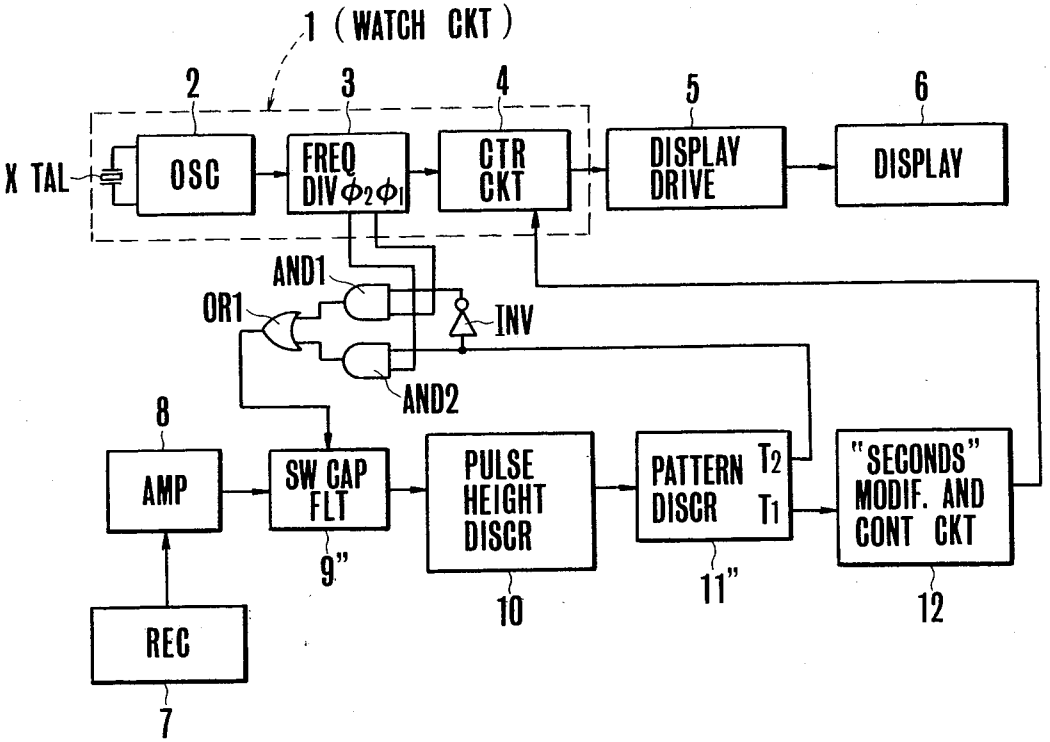
FIG. 12 is a block diagram of an electronic watch with an automatic time indication modifier according to another embodiment of the invention in which a switched capacitor filter is used to pass different time announcement signals.

FIG. 12 shows another embodiment of the electronic watch according to the invention in which a switched capacitor filter 9'' of the type shown in FIG. 11 is made to pass both notice signals of 440 Hz and a correct time signal of 880 Hz. In this Figure, blocks which are designated by like reference numerals as used in FIG. 1 represent corresponding circuit components, the only different components being the switched capacitor filter 9'' and a time announcement pattern discrimination circuit 11'''. In order to permit the filter 9'' to pass both the notice signals of 440 Hz and the correct time signal of 880 Hz, a first clock $\phi_1$ (8192 Hz) for enabling the filter 9'' to function as a band pass filter for the notice signals and a second clock $\phi_2$ (16,384 Hz) for enabling the filter to function as a band pass filter for the correct time signal of 880 Hz are derived from the frequency divider 3. These clocks are selectively supplied to the filter 9'' through a gating arrangement which includes AND gates $AND_1$, $AND_2$ and OR gate $OR_1$ and an inverter INV. The switching between the clocks $\phi_1$ and $\phi_2$ is made in accordance with an output $T_2$ from the time announcement pattern discrimination circuit 11'''.

During an initial phase of operation, gate $AND_1$ is enabled to pass the clock $\phi_1$ of 8192 Hz to the filter 9'', which therefore functions as a band pass filter for the notice signal of 440 Hz. After three notice signals are are received, the discrimination circuit recognizes this fact, and changes its output $T_2$ from an "L" to an "H" level. Consequently, gate $AND_1$ is disabled while gate $AND_2$ is enabled to supply the clock $\phi_2$ of 16,384 Hz to the filter 9''. Subsequently, when the correct time signal of 880 Hz is received, it is passed through the filter 9''. Subsequently, it is supplied to the pulse height discriminator 10 before it is introduced into the discrimination circuit 11'''. In response thereto, the discrimination circuit produces a "seconds" indication modifying signal at its output terminal $T_1$ for application to the "seconds" indication modifying and control circuit 12. Accordingly, the count in the "seconds" counter of the counter circuit 4 is modified, and the time indication of the display 6 is modified to the corrected time.

When the switched capacitor filter is used as the band pass filter in the arrangements of FIGS. 1 and 12, it can be implemented as a compact monolithic element which is essentially provided in an electronic watch. The capacitors, MOS transistors and operational amplifier which constitute the switched capacitor filter can be integrated into the integrated circuit element of the watch. Since the clocks to operate the switched capacitor filter are derived from the frequency divider of the watch, the provision of a separate clock oscillator for use with the filter is avoided, thus simplifying the overall arrangement of the watch. As mentioned previously, the characteristic of the switched capacitor filter can be controlled by a suitable choice of the clock frequency, so that the clock frequency may be selectively switched in accordance with a particular time announcement pattern which is to be discriminated.

What is claimed is:

1. An electronic watch including a watch circuit and a display, the watch circuit including a clock generator, a frequency divider coupled to said clock generator, and means coupling said display to said frequency divider, the watch being provided with an automatic time indication modifier which comprises: a microphone for picking up a correct time announcement sound from a radio, television, telephone headset or the like; an amplifier for amplifying the signal picked up by the microphone; a filter which passes only that component of the signal from the amplifier which has the same frequency as a time announcement signal; a pulse height discriminator for converting an output signal from the filter into a bi-level signal in accordance with the magnitude of the signal above a threshold level; a time announcement pattern discrimination circuit means responsive to the bi-level signal and to a reference signal provided by said frequency divider for determining the presence of a time announcement pattern on the basis of the duration of and the time interval between the bi-level signals in comparison with the period of said reference signal; and a "second" indication modifying and control circuit responsive to an output signal from the discrimination circuit to effect a modification of the "seconds" indication of the electronic watch.

2. An electronic watch according to claim 1 in which a dead period is provided in the operation of the pattern discrimination circuit means which is initiated in the region of a falling end of a time announcement signal, thereby excluding adverse influences of transient distortions which may occur in the region of the falling end of the time announcement signal.

3. An electronic watch according to claim 1 wherein said time announcement signal occurs as successive bursts and the time announcement pattern discrimination circuit means comprises first circuit means including means for generating pulses of a fixed period which is equal to or greater than the period of an input signal, the first circuit means interrupting the delivery of pulses for a time interval which depends on the width of burst contained in the time announcement pattern in the absence of an input signal between the successive bursts to determine if the input signal occurs in succession, and second circuit means for counting the pulses of the fixed period and for disabling the first circuit means for a given interval which corresponds to the time interval between the successive bursts of the time announcement pattern from the time when the operation of the first circuit means is terminated to thereby determine if the duration of and the time interval between input signals correspond to those of the time announcement pattern, a counter circuit which counts the occurrence of a next following burst signal after each termination of the operation of the second circuit means, and a timer responsive to a given count in the counter for producing a pulse a given time after the occurrence of the count.

4. An electronic watch according to claim 1 wherein the time announcement signal occurs as successive bursts and the time announcement pattern discrimination circuit means comprises first circuit means including means for producing pulses of a given period which is equal to or greater than the period of an input signal in response to the occurrence of the input signal, the first circuit means interrupting the delivery of pulses for a given time interval which depends on the duration of a burst signal contained in the time announcement pattern in the absence of an input signal between successive pulses to determine if the input signal occurs in succession, second circuit means for counting the pulses of the fixed period and for disabling the first circuit means for a given time interval which corresponds to the time interval between successive burst signals contained in the time announcement pattern when the first circuit means has terminated its operation to thereby determine if the duration of and the time interval between input signals corresponds to those of the time announcement pattern, third circuit means for counting the pulses of the given period and for counting noise signals which are inputted during the time interval when the second circuit means is in operation to disable the pulse generator when a given count is reached, and a counter for counting the occurrence of a next following burst signal after each termination of the second circuit means, the counter producing a pulse one second after the given count is reached.

5. An electronic watch according to claim 1 in which the time announcement pattern discrimination circuit includes adjustable circuit means which permit a plurality of different time announcement patterns to be determined.

6. An electronic watch according to claim 5 in which said adjustable circuit means is selectively operated by switching means.

7. An electronic watch according to claim 6 in which the switching means is operated externally of the watch.

8. An electronic watch according to claim 1 in which the filter comprises a switched capacitor filter.

9. An electronic watch according to claim 8 in which the switched capacitor filter is operated by a clock which is derived from an oscillator or a frequency divider of the watch circuit.

10. An electronic watch according to claim 5, wherein the signal picked up by the microphone occurs as a burst signal, the reference signal has a fixed period and the time announcement pattern discrimination circuit means for measuring the time duration and the time interval of the received time announcing burst signal includes digital means responsive to the reference signal for checking the width of the burst signal against a standard, and circuit means responsive to manipulation by a human for changing such standard, whereby said modifier is operable with a plurality of different time announcement patterns.

11. An electronic watch comprising:

a clock generator;

a frequency divider coupled to said clock generator;

a display device for displaying the current time in hours, minutes and seconds;

a control and display drive circuit for controlling the time displayed at said display device in response to said frequency divider and to an externally received time announcement signal, said control and display drive circuit including:

(a) discriminating means for comparing said time announcement signal against a reference signal, said discriminating means generating an enabling signal whenever said time announcement signal bears a predetermined relationship to said reference signal; and (b) means responsive to said enabling signal for correcting the time displayed at said display device by selectively advancing or retarding the time displayed thereat in response to said enabling signal leading or lagging, respectively, a predetermined time indication of said display device.

12. The watch according to claim 1, wherein said predetermined time indication is a "00" second indication at said display device.

13. The watch according to claim 1, wherein said reference signal is generated by said frequency divider and has a fixed period.

14. An electronic watch comprising:

(a) a clock generator;

(b) a frequency divider coupled to said clock generator;

(c) a display device;

(d) a control and display drive circuit for controlling the time displayed at said display device in response to said frequency divider and to an externally received time announcement signal, said control and display drive circuit including:

(i) discriminating means for comparing said time announcement signal against a reference signal, said discriminating means generating an enabling signal whenever said time announcement signal bears a predetermined relationship to said reference signal; and (ii) means responsive to said enabling signal for correcting the time displayed at said display device; and (e) a pulse generator means responsive to said reference signal for generating reference pulses of a fixed period which is equal to or greater than the period of the time announcement signal.

15. The watch according to claim 14, wherein said time announcement signal includes a burst signal having a plurality of pulses and wherein said watch further includes a counter for counting pulses, and circuit means responsive to said pulse generator means for transmitting the pulses of the burst signal received at an input thereof to said counter provided the pulses at said input bear a predetermined relationship with respect to the reference pulses generated by said pulse generator.

16. The watch according to claim 15, wherein said time announcement signal occurs as a series of successive bursts of pulses and wherein said watch further includes yet another counter for counting the number of bursts of pulses received at the input of said circuit means and means responsive to a predetermined count in said yet another counter for generating said enabling signal.

17. A method of correcting the time displayed by an electronic timepiece, said timepiece having a clock generator, a frequency divider coupled to said clock generator, a display device for displaying the time being kept by the timepiece, and a control and display drive circuit for controlling the time displayed at said display device in response to said frequency divider and to an externally received time announcement signal, said method comprising the steps of:

(a) receiving said time announcement signal;

(b) comparing the received time announcement signal against a reference signal and generating an enabling signal whenever the time announcement signal bears a predetermined relationship to the reference signal; and (c) correcting the time displayed at said display device in response to the generation of said enabling signal by selectively advancing or retarding the time display device depending upon whether the occurrence of the enabling signal leads or lags a predetermined time indication of said display device.

* * * * *